United States Patent [19]

Miyagi

[11] 4,356,803

[45] Nov. 2, 1982

[54] METHOD AND APPARATUS FOR CONTROLLING THE FUEL FEEDING RATE OF AN INTERNAL COMBUSTION ENGINE

[75] Inventor: Hideo Miyagi, Okazaki, Japan

[73] Assignee: Toyota Jidosha Kogyo Kabushiki Kaisha, Toyota, Japan

[21] Appl. No.: 240,826

[22] Filed: Mar. 5, 1981

[30] Foreign Application Priority Data

Mar. 7, 1980 [JP] Japan ..... 55-28017

[51] Int. Cl.[3] ..... F02B 3/00; F02M 13/04; F02M 51/00

[52] U.S. Cl. ..... 123/492; 123/493; 123/494

[58] Field of Search ..... 123/492, 493, 494

[56] References Cited

U.S. PATENT DOCUMENTS

| | | | |
|---|---|---|---|
| 3,593,692 | 7/1971 | Scholl et al. | 123/484 |
| 3,673,989 | 7/1972 | Aono et al. | 123/492 |
| 3,858,561 | 1/1975 | Aono | 123/492 |
| 3,911,872 | 10/1975 | Hughes | 123/494 |
| 3,926,153 | 12/1975 | Reddy | 123/493 |
| 4,205,377 | 5/1980 | Ayama et al. | 123/494 |
| 4,227,490 | 10/1980 | Kobayashi et al. | 123/492 |
| 4,266,522 | 5/1981 | Williams et al. | 123/493 |
| 4,305,365 | 12/1981 | Liznka et al. | 123/492 |
| 4,308,838 | 1/1982 | Nakano et al. | 123/492 |

*Primary Examiner*—Raymond A. Nelli

*Attorney, Agent, or Firm*—Cushman, Darby & Cushman

[57] ABSTRACT

The acceleration of an internal combustion engine is detected for generating at least one electrical signal indicating when acceleration exceeds a predetermined degree. In response to this signal, the fuel feeding rate of the engine is instantly increased by a predetermined increment. After each increasing operation is executed, the increased fuel feeding rate is decreased with a variable reduction rate. The variable reduction rate, according to the present invention, is decreased in accordance with the lapse of time after the increasing operation has been executed.

12 Claims, 13 Drawing Figures

METHOD AND APPARATUS FOR CONTROLLING THE FUEL FEEDING RATE OF AN INTERNAL COMBUSTION ENGINE

BACKGROUND OF THE INVENTION

The present invention relates to a method of and apparatus for controlling the fuel feeding rate of an internal combustion engine during and after acceleration.

In an internal combustion engine having an electronically controlled fuel injection system which controls the fuel feeding rate by using fuel injection valves or other fuel control valves, the fuel feeding rate is instantly increased by a predetermined increment when the engine is accelerating. Then, the incremental amount of fuel injected as a result of the acceleration operation (hereinafter called as "the acceleration increment") gradually decreases to zero with the lapse of time unless the next acceleration operation occurs. According to the conventional method of controlling the fuel feeding rate, however, the reduction rate of the acceleration increment has been always maintained at a constant value. Therefore, if the required acceleration increment is varied depending upon the operating condition of the engine or upon the acceleration degree of the engine, it is difficult to always obtain optimum reduction characteristics of the acceleration increment. Accordingly, response characteristics of the engine deteriorate during acceleration to impair the acceleration feeling. Furthermore, since the air-fuel ratio becomes too rich, excessive fuel consumption takes place, the efficiency of purifying noxious components in the exhaust gas is reduced and excessive carbon is deposited on the spark plugs.

SUMMARY OF THE INVENTION

It is, therefore, an object of the present invention to provide a method of and apparatus for controlling the fuel feeding rate of an internal combustion engine, whereby good acceleration characteristics can be obtained, and air-fuel mixture can be always controlled to an optimum air-fuel ratio during and after acceleration.

According to the present invention, at least one electrical signal is generated when the degree of acceleration of the engine exceeds a predetermined degree. The fuel feeding rate of the engine is then instantly increased by a predetermined increment in response to the electrical signal. Each time the increasing step has been executed, the increased fuel feeding rate is decreased at a variable rate which rate decreases in accordance with the lapse of time after the increasing step has been executed.

The above and other related objects and features of the present invention will be apparent from the description of the present invention set forth below, with reference to the accompanying drawings, as well as from the appended claims.

DETAILED DESCRIPTION OF PREFERRED EMBODIMENTS

Figure 1:
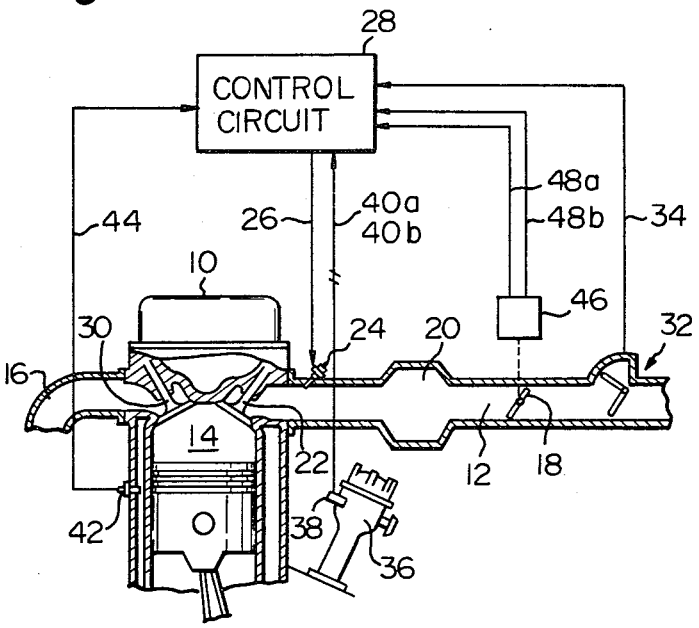
FIG. 1 schematically illustrates an internal combustion engine having an electronically controlled fuel injection system according to the present invention.

Referring to FIG. 1, reference numeral 10 denotes an engine, 12 denotes an intake passage, 14 denotes a combustion chamber, and 16 denotes an exhaust passage. The flow rate of the air introduced through the air cleaner which is not diagrammatized is controlled by a throttle valve 18 that is interlocked to an accelerator pedal which is not diagrammatized. The intake air is introduced into the combustion chamber 14 via a surge tank 20 and an intake valve 22. A fuel injection valve 24 is installed in the intake passage 12 in the vicinity of the intake valve 22, and is opened and closed responsive to electric drive pulses that are fed from a control circuit 28 via a line 26. The fuel injection valve 24 injects the compressed fuel that is supplied from a fuel supply system which is not diagrammatized. The exhaust gas which is produced by the combustion in the combustion chamber 14 is exhausted into the open air through an exhaust valve 30, an exhaust passage 16 and through a catalytic converter which is not diagrammatized.

An air-flow sensor 32 is provided in the intake passage 12 in the upstream of the throttle valve 18, detects the flow rate of the air that is intaken, and sends an output signal to the control circuit 28 via a line 34.

A crank angle sensor 38 which is installed in a distributor 36 produces pulse signals after every rotation of the crankshaft (not illustrated) of the engine at 30° and 360°. The pulse signals produced at every crankshaft rotation of 30° are fed to the control circuit 28 via a line 40*a*, and the pulse signals produced at every crankshaft rotation of 360° are fed to the control circuit 28 via a line 40*b*.

The output signal of a water-temperature sensor 42 which detects the temperature of the coolant in the engine is fed to the control circuit 28 via a line 44.

A throttle sensor 46 interlocked to the throttle valve 18 produces pulse signals each time the throttle valve 18 is turned by a predetermined angle in the direction in which it opens, and the pulse signals are fed to the control circuit 28 via lines 48*a* and 48*b*.

Figure 2:
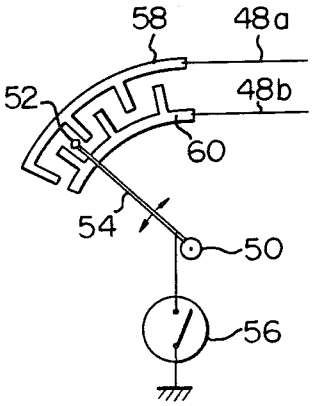
FIG. 2 illustrates a throttle sensor shown in FIG. 1.

FIG. 2 illustrates schematic construction of the above-mentioned throttle sensor 46, in which reference numeral 50 denotes a rotary shaft of the throttle valve 18. An arm 54 having a slide contact 52 at the tip is attached to the rotary shaft 50. The slide contact 52 is electrically grounded via a switch 56. The switch 56 has been so constructed that the contact is closed only when the throttle valve 18 is rotated in the direction in which it opens. As the rotary shaft 50 rotates, the slide contact 52 slides to alternatingly come into contact with conductors 58 and 60 of the shape of comb teeth that are arrayed in a staggering manner relative to each other. Therefore, when the throttle valve 18 is rotated in the direction in which it opens, the potential in the conductors 58 and 60 alternatingly assumes the ground potential every after the throttle valve 18 is turned at a predetermined angle. The thus produced pulse signals are sent to the control circuit 28 via lines 48*a* and 48*b*.

Figure 3:
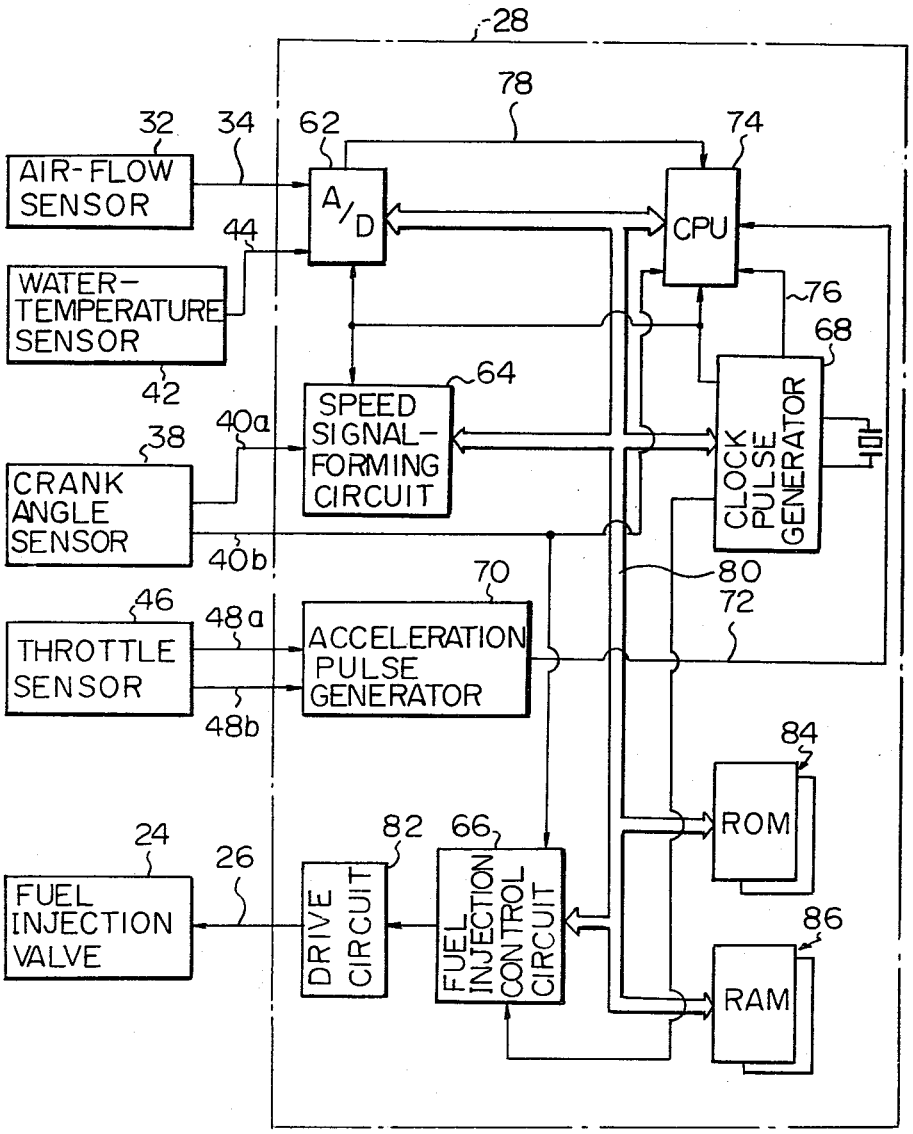
FIG. 3 illustrates a control circuit shown in FIG. 1.

FIG. 3 is a block diagram illustrating the control circuit 28 of FIG. 1, in which the air-flow sensor 32, water-temperature sensor 42, crank angle sensor 38, throttle sensor 46 and fuel injection valve 24 that are illustrated in FIG. 1 are represented by blocks, respectively.

The output signals of the air-flow sensor 32 and the water-temperature sensor 42 are fed to an analog-to-digital converter 62 which contains an analog multiplexer, and are converted into digital signals.

Pulses produced by the crank angle sensor 38 at every crankshaft rotation of 30° are fed to a speed signal-forming circuit 64 via the line 40*a*, and pulses produced at every crankshaft rotation of 360° are fed, as fuel injection initiation signals, to a fuel injection control circuit 66 via the line 40*b* and are further fed, as interrupt request signals for the fuel injection time arithmetic operation, to a first interrupt input port of a central processing unit (CPU) 74 consisting of microprocessors. The speed signal-forming circuit 64 has a gate which is opened and closed by the pulses produced at every crankshaft rotation of 30° and a counter for counting the number of clock pulses which are fed from a clock generator circuit 68 via the gate, and forms a speed signal having a value which corresponds to the running speed of the engine.

The pulse signals produced by the throttle sensor 46 are applied to an acceleration pulse generator circuit 70 which produces acceleration pulses having a frequency which varies depending upon the accelerating degree. The acceleration pulses produced by the generator circuit 70 are fed, as interrupt request signals, to a second interrupt input port of the CPU 74 via a line 72.

Third and fourth interrupt input ports of the CPU 74 receive interrupt request signals for completing the analog-to-digital conversion sent from the analog-to-digital (A/D) converter 62 via a line 78, and interrupt request signals for time sent via a line 76 from a clock generator circuit 68 which accommodates a timer circuit, respectively. The interrupt request for the fuel injection time arithmetic operation has the highest priority, the interrupt request for completing the analog-to-digital conversion has the second highest priority, the interrupt request for the acceleration pulses has the third highest priority, and the interrupt request for time has the smallest priority.

A fuel injection control circuit 66 has a presettable down counter and an output register. An output data which corresponds to one time of the injection time $\tau$ of the fuel injection valve 24 is sent from the CPU 74 via a bus 80, and is set to the output register. As the pulses (fuel injection initiation signals) produced by the crank angle sensor 38 at every crankshaft rotation of 360° are applied, the thus set data is loaded to the down counter. At the same time, the output of the down counter is inverted to assume a high level, and then the loaded value is subtracted one by one for each application of the clock pulse from the clock generator circuit 68. When the loaded value becomes zero, the output of the down counter is inverted into a low level. Therefore, the output of the fuel injection control circuit 66 becomes an injection signal having a duration which is equal to the injection time $\tau$, and is fed to the fuel injection valve 24 via a drive circuit 82.

The A/D converter 62, the speed signal-forming circuit 70 and the fuel injection control circuit 66 are connected via a bus 80 to the CPU 74, read-only memory (ROM) 84, random access memory (RAM) 86, and clock generator circuit 68, which constitute the microcomputer. Via the bus 80, the input data and output data are transferred. Although not diagrammatized in FIG. 3, the microcomputer is provided with an input port, an output port, an input/output control circuit, a memory control circuit, and the like as is customary. In the ROM 84, there will have been stored beforehand a routine program for main processing that will be mentioned later, an interrupt processing program for the arithmetic operation of the fuel injection time, an interrupt processing program for the arithmetic operation of the fuel increment, and various data that are necessary for carrying out the arithmetic operation.

Figure 4:
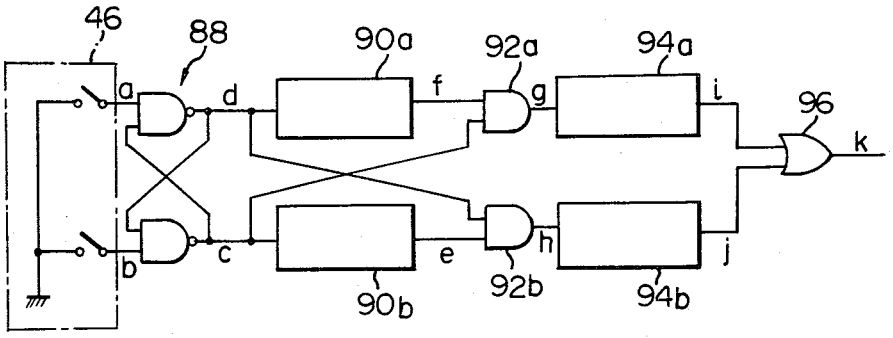
FIG. 4 illustrates an acceleration pulse generator shown in FIG. 1.
Figure 5:
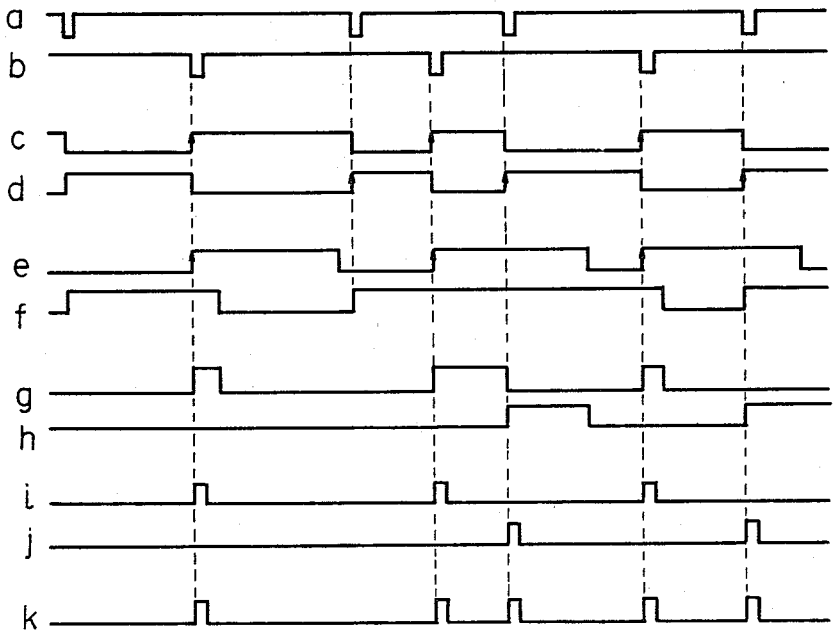
FIG. 5 illustrates wave-forms of signals obtained at various points in the circuit shown in FIG. 4.

FIG. 4 illustrates the acceleration pulse generator circuit 70 of FIG. 3, and FIG. 5 is a time chart of the circuit 70. In FIG. 4, reference numeral 46 functionally denotes the throttle sensor of FIG. 2. When the throttle valve 18 is turned, and signals as denoted by a and b of FIG. 5 are applied from the throttle sensor 46 to the reset input and set input of the R-S flip-flop 88, respectively, the outputs Q and $\overline{Q}$ become as denoted by c and d in FIG. 5. The outputs Q and $\overline{Q}$ are applied to retriggerable monostable multivibrators 90*b* and 90*a*, respectively. The outputs of the monostable multivibrators 90*b* and 90*a* will be as indicated by e and f in FIG. 5, respectively. The logical product of the output f of the monostable multivibrator 90*a* and the Q output c of the flip-flop 88, and the logical product of the output e of the monostable multivibrator 90*b* and the $\overline{Q}$ output d of the flip-flop 88, are formed by AND circuits 92*a* and 92*b*, respectively. The logical product outputs g and h (refer to FIG. 5) are applied to monostable multivibrators 94*a* and 94*b*, respectively. The monostable multivibrators 94*a* and 94*b* then produce respective outputs as denoted by i and j in FIG. 5. The logical sum of these outputs i and j is formed in an OR circuit 96, whereby an acceleration pulse as denoted by k in FIG. 5 is finally obtained. Namely, as the turning rate of the throttle valve 18 is increased in the direction in which it opens, the acceleration pulses are so controlled that their occurring frequency is increased. As will be mentioned later, the acceleration pulses are used as interrupt request signals for the routine of arithmetic operation for increasing the fuel.

Next, operation of the microcomputer in the control circuit 28 will be illustrated with reference to the flow charts of FIGS. 6 to 8.

In the routine for main processing, the CPU 74 introduces a new data which indicates the running speed N of the engine from the speed signal-forming circuit 64, and stores it in a predetermined region in the RAM 86. The CPU 74 further introduces a new data which indicates the flow rate Q of the air intaken by the engine and a new data which indicates the water temperature relying upon the routine for interrupting and processing the analog-to-digital conversion executed at every predetermined period of time, and stores them in predetermined regions in the RAM 86.

Figure 6:
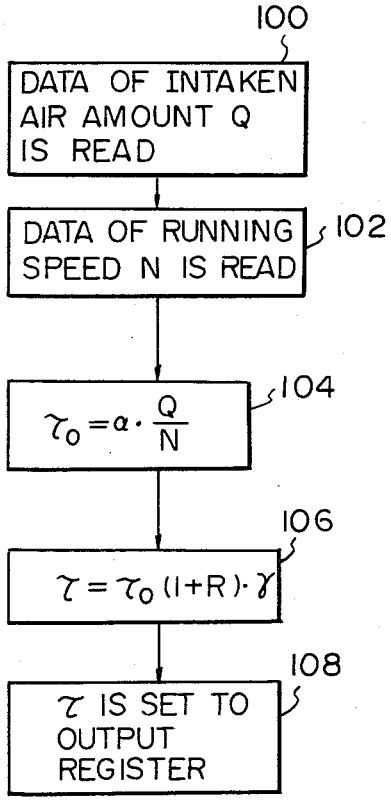
FIGS. 6, 7 and 8 illustrate flow charts of control programs according to one embodiment of the present invention.

As the interrupt request signal is introduced at every crankshaft rotation of 360° via the line 40b, the CPU 74 executes the routine for arithmetically operating the fuel injection time as illustrated in FIG. 6. First, the data related to the flow rate Q of the intake air and the running speed N are derived from the RAM 86 at the points 100 and 102, and a fundamental injection time $\tau_0$ of the fuel injection valve 24 is calculated at the point 104 in accordance with the following relation (where $\alpha$ is a constant), $$\tau_0 = \alpha \cdot Q/N$$

At the next point 106, the fundamental injection time $\tau_0$ is corrected by using an acceleration increment R which is varied in first and second interrupt routines below and other correction coefficients $\gamma$, thereby calculating the injection time $\tau$. Namely, the following operation $$\tau = \tau_0 \cdot (1+R) \cdot \gamma$$

is carried out at the point 106. Then, the data $\tau$ obtained at the point 108 is fed to the output register in the fuel injection control circuit 66 to complete the interrupt processing.

Figure 7:
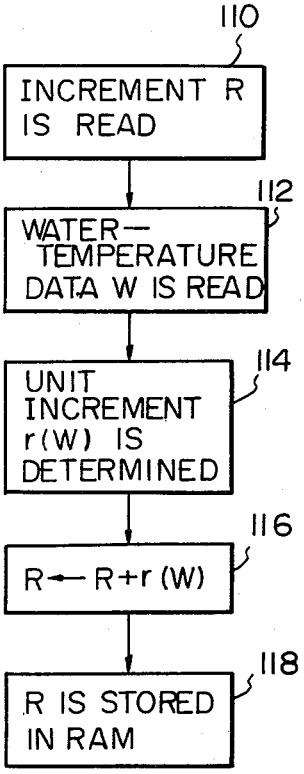
Figure 9:
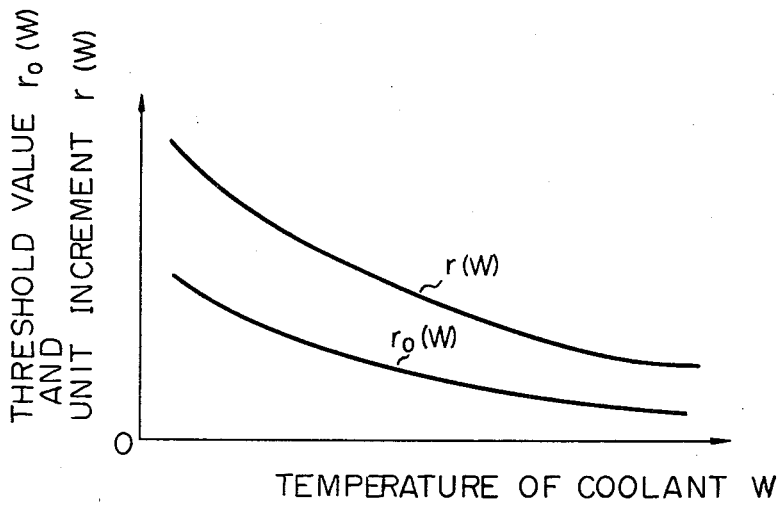
FIG. 9 illustrates the relationship of the unit increment r(w) and the threshold value $r_0(W)$ with respect to temperature of the coolant.

As the interrupt request signal by the acceleration pulse is applied, the CPU 74 executes the first interrupt routine for increasing the acceleration increment R as shown in FIG. 7. Namely, at the point 110, an initial value of an acceleration increment R obtained by the second interrupt routine for decreasing the acceleration increment R is derived from a predetermined region in the RAM 86, and a water-temperature data W of the engine is derived at the point 112 from a predetermined region of the RAM 86. Then, at the point 114, a unit increment r(W) corresponding to the thus obtained water-temperature data W is found from a table in the ROM 84. Thereafter, at the point 116, the increment R is increased in a manner of $R \leftarrow R + r(W)$ and is renewed. At the point 118, the renewed increment R is written on the RAM 86 to complete the interrupt treatment. In the ROM 84 has been stored beforehand, as shown in FIG. 9, the unit increment r(W) which varies responsive to the water temperature of the engine, in the form of a table corresponding to the data W of water temperature. As will be obvious from FIG. 9, the unit increment r(W) is set to be great when the temperature of the coolant is low. Therefore, the fuel during the acceleration is supplied in larger amounts when the engine is not warmed up than when the engine is fully warmed up.

Figure 8:
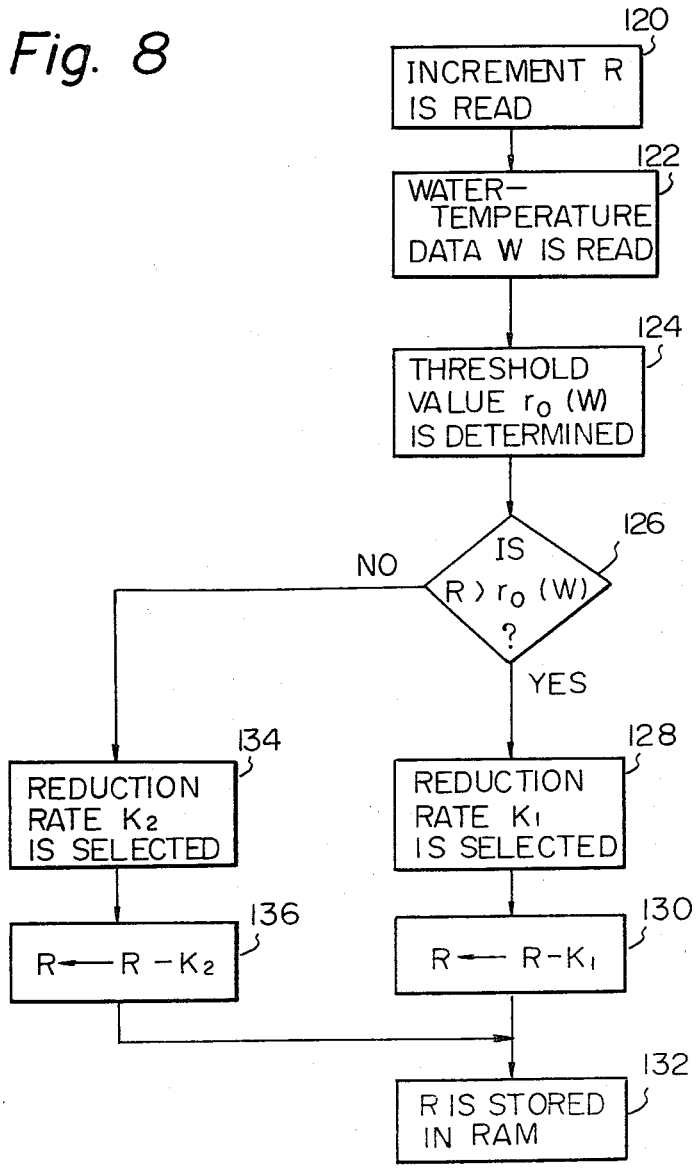

As the interrupt request signal is applied by the clock generator circuit 68 at every predetermined period of time, for example, at every 20 milliseconds, the CPU 74 executes the second interrupt routine as shown in FIG. 8. Namely, the acceleration increment R obtained in the first interrupt routine or the increment R obtained in the previous second interrupt routine is read out from a predetermined region of the RAM 86 at the point 120, and the water-temperature data W of the engine is derived from a predetermined region of the RAM 86 at the point 122. Then, at the point 124, a threshold value $r_0(W)$ for changing the reduction rate corresponding to the water-temperature data W is found from the table of ROM 84. The point 126 then discriminates whether $R > r_0(W)$ or not. When $R > r_0(W)$, the program proceeds to the point 128 where a constant $K_1$ is selected as a reduction rate for the increment R. At the point 130, the operation is carried out in a way $R \leftarrow R - K_1$ to reduce the acceleration increment R by $K_1$. The program then proceeds to the point 132 where the thus reduced increment R is written down on the RAM 86 to complete the interrupt processing. When it is so discriminated that $R \leqq r_0(W)$ at the point 126, the program proceeds to the point 134 where a constant $K_2$ is selected as a reduction rate for the increment R. The point 136 then performs the operation $R \leftarrow R - K_2$ to reduce the increment R by $K_2$. The program then proceeds to the point 132. Here, however, $K_1$ is always greater than $K_2$. As shown in FIG. 9, the threshold value $r_0(W)$ for changing the reduction rate which varies responsive to the water temperature of the engine has been stored beforehand in the ROM 84 in the form of a table which corresponds to the data W of water temperature. To meet the characteristics of unit increment r(W), the threshold value $r_0(W)$ has been so set as to increase with the decrease in the water temperature.

Figure 10:
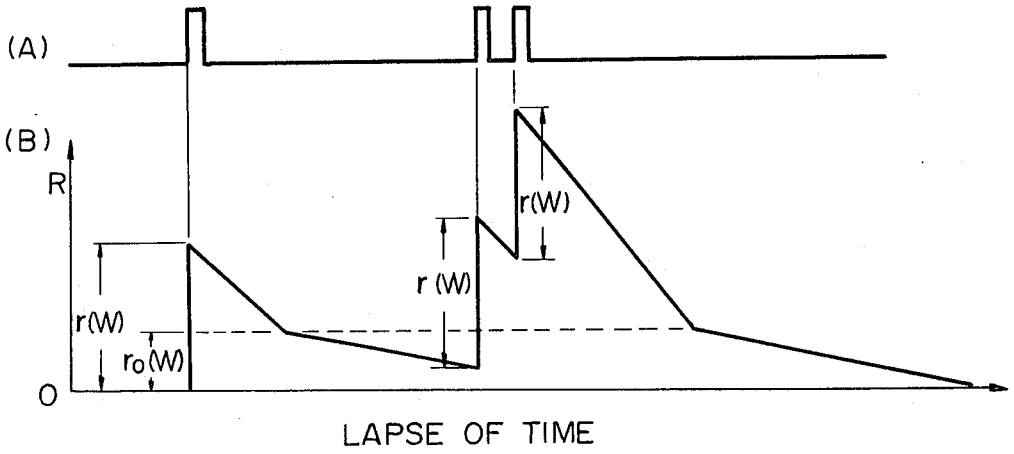
FIG. 10 illustrates an operation of the above-mentioned embodiment.

Hereinafter, the functions and effects of the embodiment of the invention will be illustrated with reference to FIG. 10, in which (A) denotes acceleration pulses, and (B) denotes acceleration increment R. When the acceleration pulses are generated responsive to the opening speed of the throttle valve 18, i.e., responsive to the degree of acceleration, the CPU 74 executes the first interrupt routine as shown in FIG. 7. Therefore, the acceleration increment R is increased by the unit increment r(W) which is determined by the water temperature of that time, i.e., determined responsive to the warmed-up state of the engine, at every acceleration pulse. Then, since the CPU 74 executes the second interrupt routine shown in FIG. 8 at every predetermined period of time, the acceleration increment R is gradually reduced with respect to the lapse of time. When the increment R is greater than the threshold value $r_0(W)$, a large value is selected for the rate of reduction. When the increment R is equal to, or smaller than the threshold value $r_0(W)$, a small value is selected for the rate of reduction. Thus, since the reduction rate for the increment R can be selectively changed responsive to the value of the increment R of that moment, it is possible to control the fuel increment to meet the characteristics of the fuel increment required by the engine during the acceleration operation. Namely, with the fuel increment being controlled as in this embodiment, the acceleration feeling can be enhanced by increasing the feeding rate of the fuel depending upon the degree of acceleration and then the increment of fuel is quickly decreased in the initial stage of the acceleration. After the increment of fuel is rapidly decreased to some extent, the acceleration increment of fuel is then slowly decreased, in order to prevent the air-fuel ratio from becoming too rich while maintaining good acceleration characteristics. Consequently, it is possible to prevent excessive fuel consumption, to increase the effect for purifying exhaust gases, and to prevent the depositing of carbon in the spark plugs.

In the above-mentioned first embodiment, there is only one theshold value for changing the reduction rate for the acceleration increment R, and the reduction rate has been divided into two steps. According to the present invention, however, the reduction rate may be divided into three or more steps. In this case, the threshold value can be set to assume a plurality of values correspondingly. The mechanism of control becomes complex with the increase in the number of steps of the reduction rate, which, however, makes it possible to obtain more excellent fuel increment characteristics.

A second embodiment of the present invention will now be illustrated below. The second embodiment is quite the same as the first embodiment with the exception of using a routine for arithmetic operation illustrated in FIG. 11 in place of the second interrupt routine for decreasing the acceleration increment R (refer to FIG. 8) employed in the above-mentioned first embodiment. Therefore, the following description deals only with the second interrupt routine.

Figure 11:
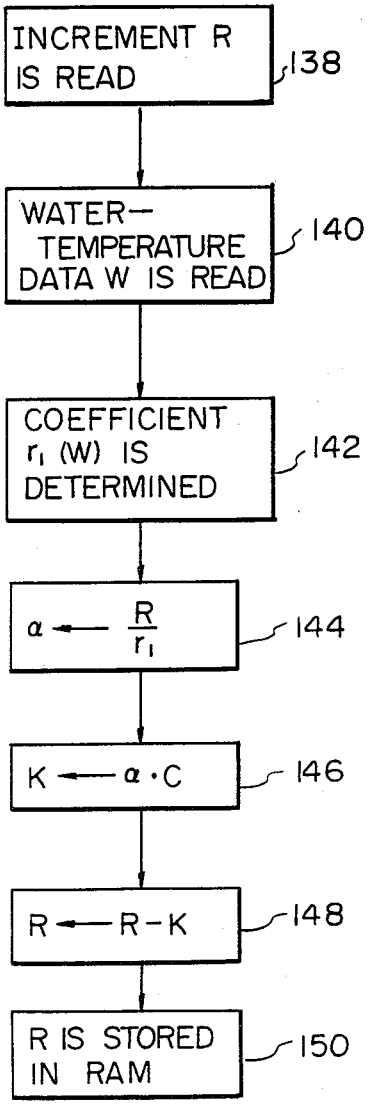
FIG. 11 illustrates a flow chart of a control program according to another embodiment of the present invention.
Figure 12:
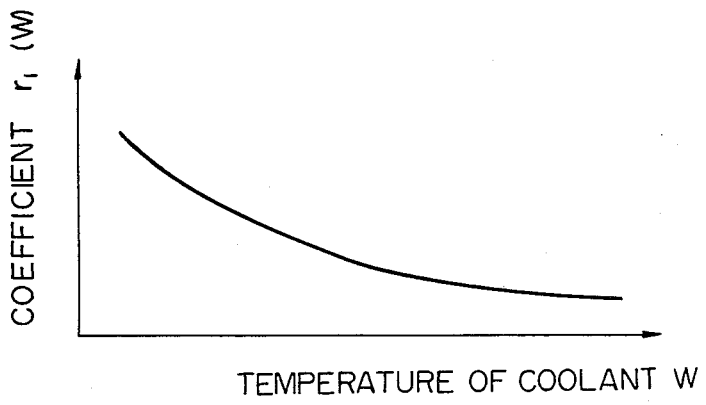
FIG. 12 illustrates the relationship of the coefficient $r_1(W)$ with respect to the temperature of coolant.

The CPU 74 executes the routine for arithmetic operation shown in FIG. 11 responsive to an interrupt request signal produced by the clock generator circuit 68 after each predetermined period of time has passed. At the point 138, first, the acceleration increment R obtained in the first interrupt routine or in the previous second interrupt routine is derived from a predetermined region in the RAM 86. Thereafter, the water-temperature data W of the engine is derived from a predetermined region of the RAM 86 at the point 140. At the point 142, a coefficient $r_1(W)$ corresponding to the water-temperature data W is found from the table in the ROM 84. Then, the points 144 and 146 execute the operations $\alpha \leftarrow R/r_1$ and $K \leftarrow \alpha \cdot C$, where C denotes a predetermined constant. The point 148 then performs the operation $R \leftarrow R - K$ to decrease the increment R by K. The program then proceeds to the point 150, where the increment R that is reduced is written on the RAM 86 to complete the interrupt treatment. In the ROM 84 has been stored beforehand the coefficient $r_1(W)$ which varies responsive to the water temperature of the engine, i.e., which assumes a large value when the water temperature is low and the engine has not been sufficiently warmed up, in the form of a table which corresponds to the water-temperature data, as shown in FIG. 12.

Figure 13:
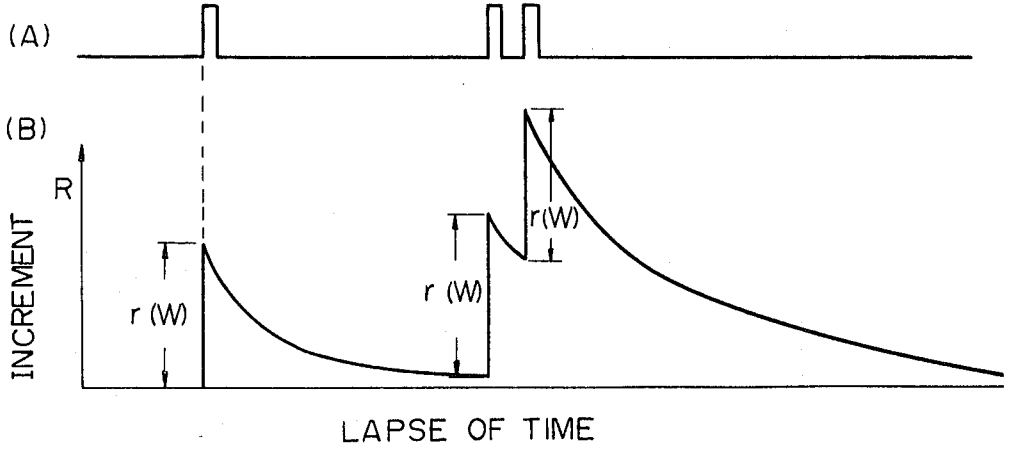
FIG. 13 illustrates the operation of the latter embodiment.

According to the second embodiment as illustrated in the foregoing, the acceleration increment R is decreased by $R/r_1 \cdot C$ at every predetermined period of time; the rate of reduction is large when the increment R is great, and is small when the increment R is small. FIG. 13 illustrates the above-mentioned state, in which (A) denotes acceleration pulses and (B) denotes the acceleration increment R. As will be obvious from FIG. 13, the second embodiment of the present invention presents the same effects as those of the above-mentioned first embodiment. According to the second embodiment, furthermore, the second interrupt routine for decreasing the acceleration increment can be simplified to contribute to the decrease in the quantity of software.

According to the present invention as illustrated in detail in the foregoing, the acceleration increment of fuel is, first, greatly reduced and is then reduced at a small rate with the lapse of time after the fuel has been instantly increased by acceleration. Therefore, the acceleration increment can be selected at a sufficiently large value when the acceleration is being initiated, in order to obtain good characteristics of the acceleration operation. Moreover, since the increment of fuel is quickly reduced immediately after the fuel has been instantly increased by acceleration; excessive fuel consumption can be prevented, the efficiency for purifying the exhaust gas will not be decreased, and excessive carbon will not be deposited in the spark plugs even when the fuel increment for acceleration is increased while the engine has not been sufficiently warmed up.

As many widely different embodiments of the present invention may be constructed without departing from the spirit and scope of the present invention, it should be understood that the present invention is not limited to the specific embodiments described in this specification, except as defined in the appended claims.

I claim:

1. A method of controlling the fuel feeding rate of an internal combustion engine, comprising the steps of:

generating at least one first electrical signal when acceleration of said engine exceeds a predetermined degree;

instantly increasing the fuel feeding rate of the engine by a predetermined increment in response to said first electrical signal; and after each execution of said increasing step, decreasing the increased fuel feeding rate with a variable reduction rate which reduction rate decreases in accordance with the lapse of time after said increasing step has been executed.

2. A method as claimed in claim 1, wherein:

said method further comprises a step of comparing the increased fuel feeding rate with at least one threshold value after said increasing step has been executed; and said decreasing step includes the step of stepwise decreasing said variable reduction rate in accordance with the result of said comparison.

3. A method as claimed in claim 2, wherein:

said method further comprises a step of generating a second electrical signal related to the warmed-up condition of the engine; and said comparing step includes the step of changing said at least one threshold level in response to said second electrical signal.

4. A method as claimed in claim 1, wherein said decreasing step includes the step of continuously decreasing said variable reduction rate in accordance with the lapse of time after said increasing step has been executed.

5. A method as claimed in claim 4, wherein:

said method further comprises a step of generating a second electrical signal related to the warmed-up condition of the engine; and said variable reduction rate is changed in response to said second electrical signal.

6. A method as claimed in claim 1, 2, 3, 4, or 5, wherein the engine has a throttle valve, and said first electrical signal generating step comprises a step of generating at least one first electrical signal when the opening speed of the throttle valve exceeds a predetermined value.

7. An apparatus for controlling the fuel feeding rate of an internal combustion engine, comprising:

means for generating at least one first electrical signal when acceleration of said engine exceeds a predetermined degree;

means for substantially instantly increasing the fuel feeding rate of said engine by a predetermined increment in response to said first electrical signal; and means for decreasing, after each of said fuel feeding rate increases, said fuel feeding rate by a variable reduction rate, said variable reduction rate decreasing with time measured from said fuel feeding rate increases.

8. The apparatus of claim 7 further comprising:

means for generating a threshold value after each of said fuel feeding rate increases; and means for comparing said increased fuel feeding rate with said threshold value, said decreasing means stepwise decreasing said variable reduction rate in accordance with said comparison.

9. The apparatus of claim 8 including means for generating a second electrical signal related to engine temperature, said threshold generating means changing said at least one threshold value in response to said second electrical signal.

10. The apparatus of claim 7 wherein said decreasing means continuously decreases said variable reduction rate with time measured from said fuel feeding rate increase.

11. The apparatus of claim 10 further comprising:

means for detecting the temperature of said engine; and means for for generating a second electrical signal related to engine temperature, said decreasing means changing said variable reduction rate in response to said second electrical signal.

12. The apparatus of claim 7, 8, 9, 10 or 11 wherein:

said engine includes a throttle valve; and said first electrical signal generating means includes means for generating at least one first electrical signal when the opening speed of the throttle valve exceeds a predetermined value.

* * * * *